US005113805A

United States Patent [19]

Kawamura

[11] Patent Number: 5,113,805

[45] Date of Patent: May 19, 1992

[54] VARIABLE-CYCLE ENGINE

[75] Inventor: Hideo Kawamura, Samukawa, Japan

[73] Assignee: Isuzu Ceramics Research Institute Co., Ltd., Fujisawa, Japan

[21] Appl. No.: 626,532

[22] Filed: Dec. 12, 1990

[30] Foreign Application Priority Data

Dec. 12, 1989 [JP] Japan ..... 1-322425
Dec. 15, 1989 [JP] Japan ..... 1-325465

[51] Int. Cl.[5] ..... F02B 69/00
[52] U.S. Cl. ..... 123/21; 123/188.5
[58] Field of Search ..... 123/21, 65 R, 65 VD, 123/65 BA, 65 A, 190 C, 188 C, 80 C

[56] References Cited

U.S. PATENT DOCUMENTS 1,077,363 11/1913 Nash ..... 123/21
1,274,777 8/1918 Prescott ..... 123/21
5,005,539 4/1991 Kawamura ..... 123/21
5,007,382 4/1991 Kawamura ..... 123/21
5,022,353 6/1991 Kamamura ..... 123/21

FOREIGN PATENT DOCUMENTS 0058619 8/1982 European Pat. Off. .
0396325 11/1990 European Pat. Off. .
2219346 12/1989 United Kingdom .

*Primary Examiner*—E. Rollins Cross
*Assistant Examiner*—M. Macy
*Attorney, Agent, or Firm*—Staas & Halsey

[57] ABSTRACT

A variable-cycle engine selectively operable in different cycle modes, includes a cylinder having a first intake port and an exhaust port which are defined in an upper portion thereof, and a second intake port defined in a lower portion thereof, a cylinder sleeve fitted in the cylinder and having a third intake port defined in a lower portion thereof, a sleeve valve circumferentially rotatably fitted over the cylinder sleeve, for selectively opening and closing the third intake port into and out of communication with the second intake port, the sleeve valve having an permanent magnet joined thereto, an actuator for rotating the sleeve valve under electromagnetic forces acting on the permanent magnet, and a turbocharger for supplying air under pressure to the first intake port and the second intake port. When the engine rotates at a low speed under a large load, the engine operates in a two-cycle mode of the uniform flow type. When the engine rotates at a high speed or at low speed under a small load, the engine operates in a four-cycle engine.

5 Claims, 3 Drawing Sheets

VARIABLE-CYCLE ENGINE

BACKGROUND OF THE INVENTION

1. Field of the Invention

The present invention relates to a variable-cycle engine which selectively operates in a two-cycle mode and a four-cycle mode depending on the rotational speed of the engine and the load on the engine.

2. Description of the Prior Art

Ordinary reciprocating engines are roughly grouped into two-cycle engines in which the intake, compression, power, and exhaust strokes are performed while the pistons reciprocate one stroke, i.e., the crankshaft makes one revolution and four-cycle engines in which the above four strokes are carried out while the pistons reciprocate two strokes, i.e., the crankshaft makes two revolutions.

The two-cycle engines are generally of the uniform-flow type in which intake ports are positioned in a lower portion of a cylinder sleeve, and intake air is introduced and exhaust gases are discharged simultaneously by air supplied under pressure from the intake ports when the piston is lowered. Since the explosion occurs each time the crankshaft makes one revolution, the rotational speed of the output shaft suffers less fluctuations, and the engine can produce a high-torque output.

In the four-cycle engines, intake air is drawn and exhaust gases are discharged in respective independent strokes. Therefore, the intake air and the exhaust gases are well exchanged in a high engine speed range. Accordingly, the four-cycle engine has a low fuel consumption rate when the engine speed is high.

There has been an attempt to operate an engine selectively in a two-cycle mode and a four-cycle mode so that the engine can operate with different two- and four-cycle characteristics. Since the intake ports used in the two-cycle mode are positioned in the lower portion of the cylinder sleeve, the engine is required to have a special mechanism for preventing the interior and exterior of the cylinder from communicating with each other through the intake ports when the piston is lowered during operation of the engine in the four-cycle mode.

If the opening area of the intake ports is increased for increasing the intake efficiency thereof during operation of the engine in the two-cycle mode, then the expansion stroke is shortened to reduce the engine output power, and the intake air tends to flow back when the engine rotates at high speed.

The applicant has proposed a variable-cycle engine which has a sleeve valve disposed around a cylinder sleeve for opening and closing intake ports defined in the cylinder sleeve, the sleeve valve being actuatable by an electro-magnetic solenoid through a link to open and close the intake ports as desired (see Japanese Patent Application No. 1(1989)-112507).

The proposed mechanism is however relatively complex. The sleeve valve cannot be moved with a quick response because of the inertia of the sleeve valve itself, and gaps or clearances between the movable parts and also between the movable parts and fixed parts supporting the movable parts.

SUMMARY OF THE INVENTION

In view of the aforesaid problems of the earlier variable-cycle engine, it is an object of the present invention to provide a variable-cycle engine which can selectively operate, with a quick response, in a two-cycle mode and a four-cycle mode depending on the rotational speed of the engine and the load on the engine.

Another object of the present invention is to provide a control system for controlling a variable-cycle engine to operate in a two-cycle mode when the rotational speed of the engine is lower than a predetermined speed and the load on the engine is larger than a predetermined load, and in a four-cycle mode when the rotational speed of the engine is higher than the predetermined speed and/or the load on the engine is smaller than the predetermined load.

According to the present invention, there is provided a variable-cycle engine selectively operable in different cycle modes, comprising a cylinder having a first intake port and an exhaust port which are defined in an upper portion thereof, and a second intake port defined in a lower portion thereof, a cylinder sleeve fitted in the cylinder and having a third intake port defined in a lower portion thereof, a sleeve valve circumferentially rotatably fitted over the cylinder sleeve, for selectively opening and closing the third intake port into and out of communication with the second intake port, the sleeve valve having a permanent magnet joined thereto, rotating means for rotating the sleeve valve under electromagnetic forces acting on the permanent magnet, intake port opening and closing means for selectively opening and closing the first intake port in the upper portion of the cylinder, exhaust port opening and closing means for selectively opening and closing the exhaust port in the upper portion of the cylinder, supercharging means for supplying air under pressure to the first intake port and the second intake port, and cycle mode selecting means for actuating the rotating means to rotate the sleeve valve to open the third intake port in communication with the second intake port and operating the exhaust port opening and closing means to operate the engine in a two-cycle mode, and for actuating the rotating means to rotate the sleeve valve to close the third intake port out of communication with the second intake port and operating the intake and exhaust port opening and closing means to operate the engine in a four-cycle mode, depending on the rotational speed of the engine and the load on the engine.

When the engine rotates at a low speed and under a full load, the intake ports defined in the lower portion of the cylinder are opened and the means for opening and closing an exhaust port is actuated to operate the engine in the two-cycle mode. When the engine rotates at a high speed or at a low speed and under a partial load, the intake ports are closed and the mean for opening and closing intake and exhaust ports are actuated to operate the engine in the four-stroke mode. The sleeve valve for changing the cycle modes is electromagnetically actuated. The boost pressure from the supercharging mean is applied to the first and second intake ports at all times.

The above and other objects, features and advantages of the present invention will become more apparent from the following description when taken in conjunction with the accompanying drawings in which a preferred embodiments of the present invention is shown by way of illustrative example.

DETAILED DESCRIPTION OF THE PREFERRED EMBODIMENT

A variable-cycle engine according to the present invention will be described with reference to FIGS. 1 through 3.

Figure 1:
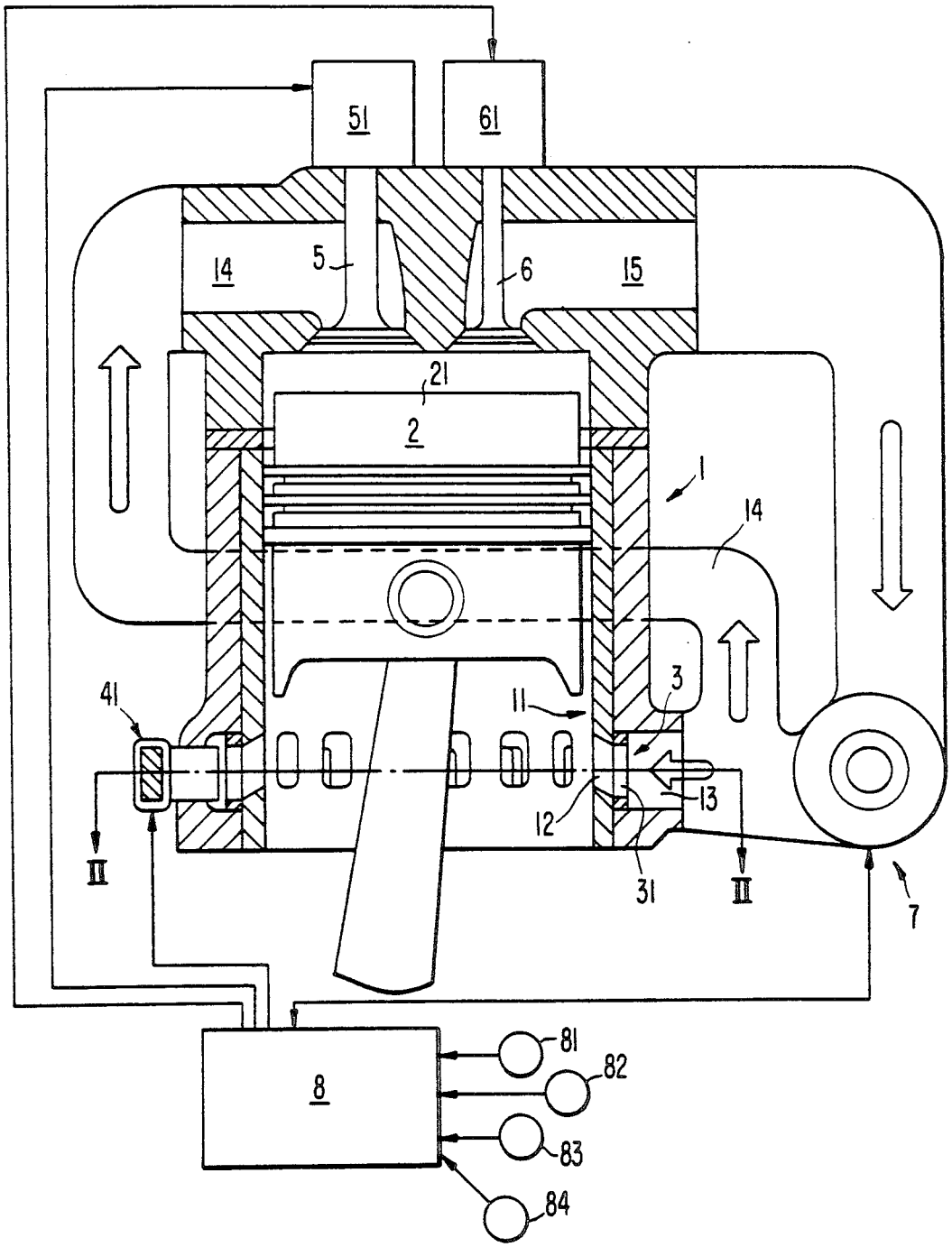
FIG. 1 is a cross-sectional view, partly in block form, of a variable-cycle engine according to the present invention.
Figure 2:
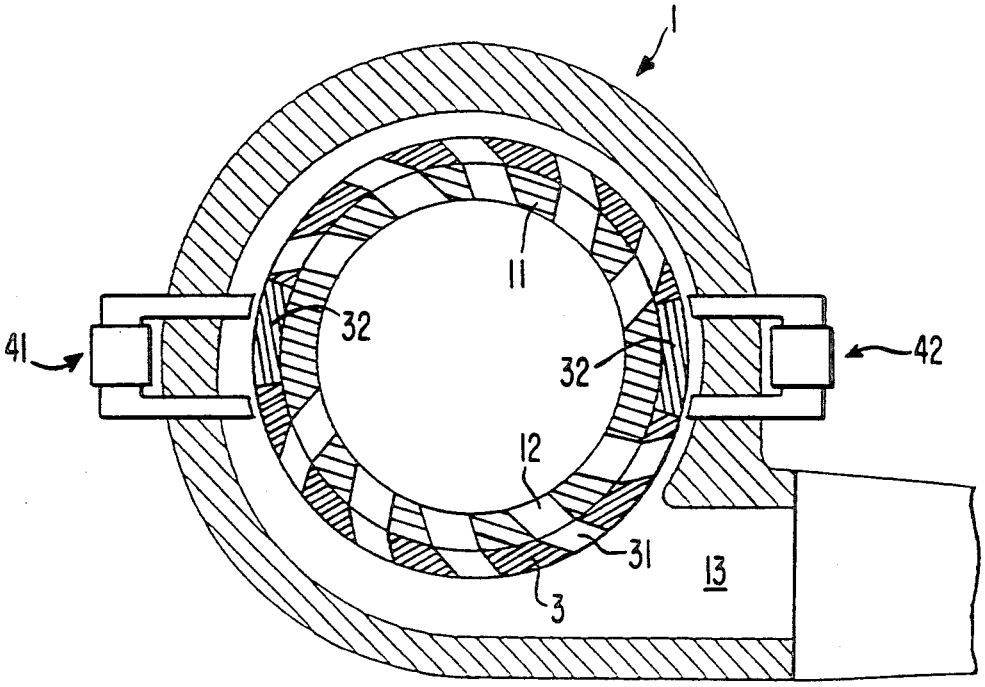
FIG. 2 is a cross-sectional view taken along line II—II of FIG. 1.

As shown in FIGS. 1 and 2, a cylinder sleeve 11 is fitted against the inner wall of a cylinder 1. A piston 2 is reciprocally fitted in the cylinder 1. The cylinder sleeve 11 has a circumferential array of intake ports 12 defined in its peripheral wall. The intake ports 12 are positioned such that they are near the upper end of a piston head 21 of the piston 2 when the piston 2 reaches the bottom dead center.

The intake ports 12 are inclined with respect to the central axis of the cylinder 1 for introducing intake air from an intake pipe 13 as a swirling flow into the cylinder 1.

A sleeve valve 3 in the form of an annular strip is fitted over the cylinder sleeve 11 in covering relation to the openings of the intake ports 12. The sleeve valve 3 is circumferentially slidable on and about the cylinder sleeve 11. The sleeve valve 3 has holes 31 defined therein and corresponding in position to the intake ports 12. When the sleeve valve 3 is angularly moved circumferentially around the cylinder 1, the intake ports 12 are covered with those portions of the sleeve valve 3 which lie between the holes 31, thereby preventing intake air from passing through the intake ports 12.

There are two permanent magnets 32 embedded diametrically oppositely in the sleeve valve 3. The sleeve valve 3 can be circumferentially moved by fixed electromagnets 41, 42 which are positioned in diametrically opposite relation to each other and can selectively confront the respective permanent magnets 32. As shown in FIG. 2, when the fixed electromagnet 42 is energized to attract one of the permanent magnets 32 in fully confronting relation thereto, the intake ports 12 and the holes 31 are aligned respectively with each other, but the fixed electromagnet 41 and the other permanent magnet 32 are not fully in confronting relation to each other.

When the fixed electromagnet 41 is energized to attract the other permanent magnet 32 in fully confronting relation thereto, the intake ports 12 are closed by the sleeve valve 3, but the fixed electromagnet 41 and said one permanent magnet 32 do not fully confront each other.

An intake valve 5 is disposed upwardly of the cylinder 1, for introducing intake air from an intake pipe 14 into the cylinder 1. The intake valve 5 can be opened and closed by an electromagnetic valve actuator 51 disposed above the intake valve 5.

An exhaust valve 6 is also disposed upwardly of the cylinder 1 adjacent to the intake valve 5, for discharging exhaust gases into an exhaust pipe 15 in an exhaust stroke of the engine. The exhaust valve 6 can be opened and closed by an electromagnetic valve actuator 61 disposed above the exhaust valve 6.

Each of the electromagnetic valve actuators 51, 61 comprises a movable magnetic pole coupled to one of the intake and exhaust valves 5, 6, and a fixed electromagnet fixedly mounted on the cylinder head. The electromagnetic valve actuators 51, 61 actuate the intake and exhaust valves 5, 6 under electromagnetic forces acting between the movable magnetic poles and the fixed electromagnets. Control signals are supplied to the fixed electromagnets from a controller 8.

A turbocharger 7 comprises a turbine, a motor-generator (TCG) which can selectively operate as a motor and a generator, and a compressor which are arranged in coaxial relationship. When the turbine is driven by the energy of exhaust gases discharged from the discharge pipe 15, the compressor is rotated to supply air under pressure to the cylinder 1 through the intake pipe 13 when the engine operates in a two-cycle mode and through the intake pipe 14 when the engine operates in a four-cycle mode.

Depending on the operating condition of the engine, the motor-generator (TCG) is supplied with electric energy and hence operates as a motor to assist in rotating the compressor for increasing the engine torque in a low engine speed range. When the energy of exhaust gases from the engine is large, the motor-generator (TCG) operates as a generator to generate electric power, which is supplied to a battery or the like.

The rotational speed of the crankshaft of the engine is detected by an engine rotation sensor 81 for the detection of the rotational speed of the engine. The amount of fuel supplied to the engine is detected by an engine load sensor 82 for the detection of the load on the engine. The crankshaft angle is detected by a position sensor 83 for the detection of the position of the piston. The boost pressure of the turbocharger 7 is detected by a pressure sensor 84. Detected signals from these sensors are applied to the controller 8.

The controller 8 comprises a microcomputer having a central processing unit for effecting arithmetic operations, various memories for storing sequences for the arithmetic operations and a control sequence, and input/output ports. When the signals from the sensors are supplied to the controller 8, the predetermined arithmetic operations are carried out, and control signals are transmitted to the fixed electromagnets 41, 42, the electromagnetic valve actuators 51, 61, and the motor-generator (TCG) of the turbocharger 7.

Figure 3:
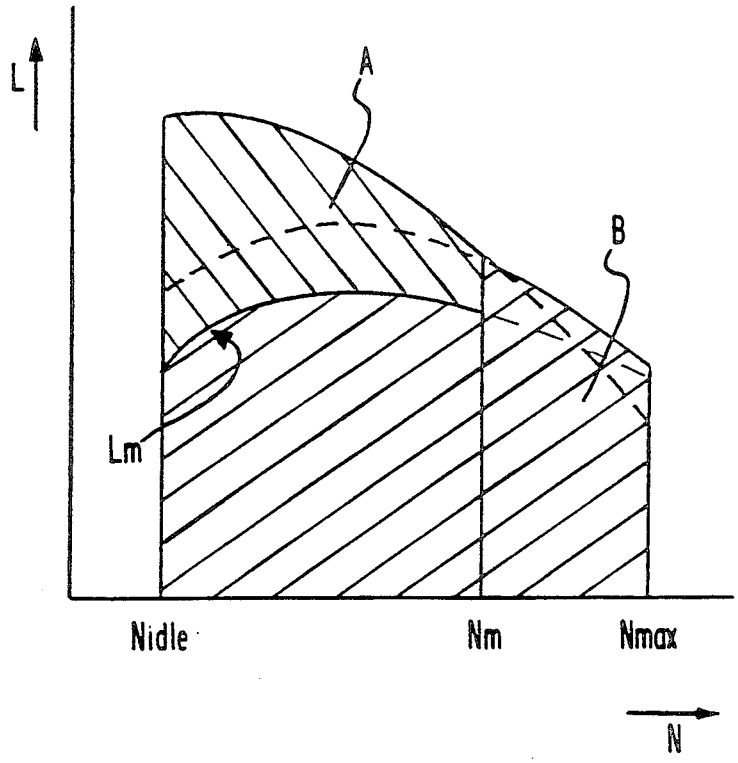
FIG. 3 is a diagram showing characteristics of two- and four-cycle modes of operation of the variable-cycle engine.

FIG. 3 shows the relationship between the load on the variable-cycle engine and the rotational speed of the engine. The graph of FIG. 3 has a vertical axis representing engine loads L and a horizontal axis representing engine rotational speeds N. The engine operates in the two-cycle mode in a region A, and in the four-cycle mode in a region B.

The variable-cycle engine shown in FIGS. 1 and 2 operates as follows:

In an engine speed rang in which the rotational speed indicated by the detected signal from the rotation sensor 81 is lower than a predetermined speed, and also in an engine load range in which the engine load indicated by the detected signal from the load sensor 82 is higher than a predetermined load, the engine operates in the two-cycle mode. More specifically, a control signal is applied to the fixed electromagnet 42 to bring the intake ports 12 and the holes 31 into alignment with each other, thereby positioning the sleeve valve 3 as shown in FIGS. 1 and 2.

The permanent magnets 32 are embedded in the sleeve valve 3. In order to generate electromagnetic forces between the permanent magnets 32 and the electromagnets 41, 42, the sleeve valve 3 and the cylinder sleeve 11 have to be made of a nonmagnetic material.

When the piston 2 is lowered toward the bottom dead center, intake air supplied under pressure from the turbocharger 7 through the intake pipe 13 flows as swirling air into the cylinder 1 through the holes 31 and the intake ports 12 which are aligned with each other. The introduced swirling air forces the exhaust gases out of the cylinder 1 through the opened exhaust port 15, and is available as intake air which is needed in the next combustion stroke.

Then, the piston 2 moves upwardly, closing the intake ports 12 of the cylinder sleeve 11. Soon thereafter, the exhaust valve 6 is closed, and the volume of the cylinder 1 is compressed. At a final stage of the compression stroke, the temperature in the cylinder 1 rises to the point where fuel can be ignited. Then, injected fuel is ignited and combusted, whereupon the piston 2 is lowered under high combustion pressure for thereby rotating the crankshaft.

In the latter half of the expansion stroke, the exhaust valve 6 is opened, and the combustion gases are discharged under their own pressure through the exhaust pipe 15 to the turbocharger 7. The exhaust gases rotate the turbine and are then discharged from the turbocharger 7.

Upon further descent of the piston 2, the gas pressure in the cylinder 1 is sufficiently lowered. When the upper end of the piston 2 reaches the intake ports 12, intake air is supplied again under pressure from the turbocharger 7 into the cylinder 1 through the intake ports 12, scavenging any remaining exhaust gases from the cylinder 1. At this time, any resistance to the influx of intake air is small and the intake air can be introduced into the cylinder 1 in a short period of time since the intake ports 12 are arrayed fully circumferentially in the lower portion of the cylinder sleeve 11 and held in communication with the holes 31 of the sleeve valve 3.

In an engine speed range in which the rotational speed indicated by the detected signal from the rotation sensor 81 is higher than the predetermined speed, or in a range in which the rotational speed indicated by the detected signal from the rotation sensor 81 is lower than the predetermined speed and the engine load indicated by the detected signal from the load sensor 82 is lower than the predetermined load, the engine operates in the four-cycle mode.

In this mode, the controller 8 controls the eectromagnetic valve actuator 51 and the fixed electromagnet 41 such that the intake valve 5 is opened and closed by the electromagnetic valve actuator 51 in the intake stroke of an ordinary four-cycle engine and the intake ports 12 of the cylinder sleeve 11 are closed by the sleeve valve 3.

When the piston 2 is lowered, since the intake ports 12 of the cylinder sleeve 11 are closed by the sleeve valve 3, the combustion gases are prevented from flowing back into the intake ports 12. In the intake stroke, sufficient intake air is introduced from the upper intake valve 5, and the stroke of the piston can effectively be utilized.

Even while the engine is operating in the two-cycle mode, the boost pressure is developed in the intake pipe 14. The sleeve valve 3 is electromagnetically actuated rather than a mechanical linkage or the like. For this reason, the mode of operation of the engine can quickly switch from the two-cycle mode to the four-cycle mode.

Figure 4:
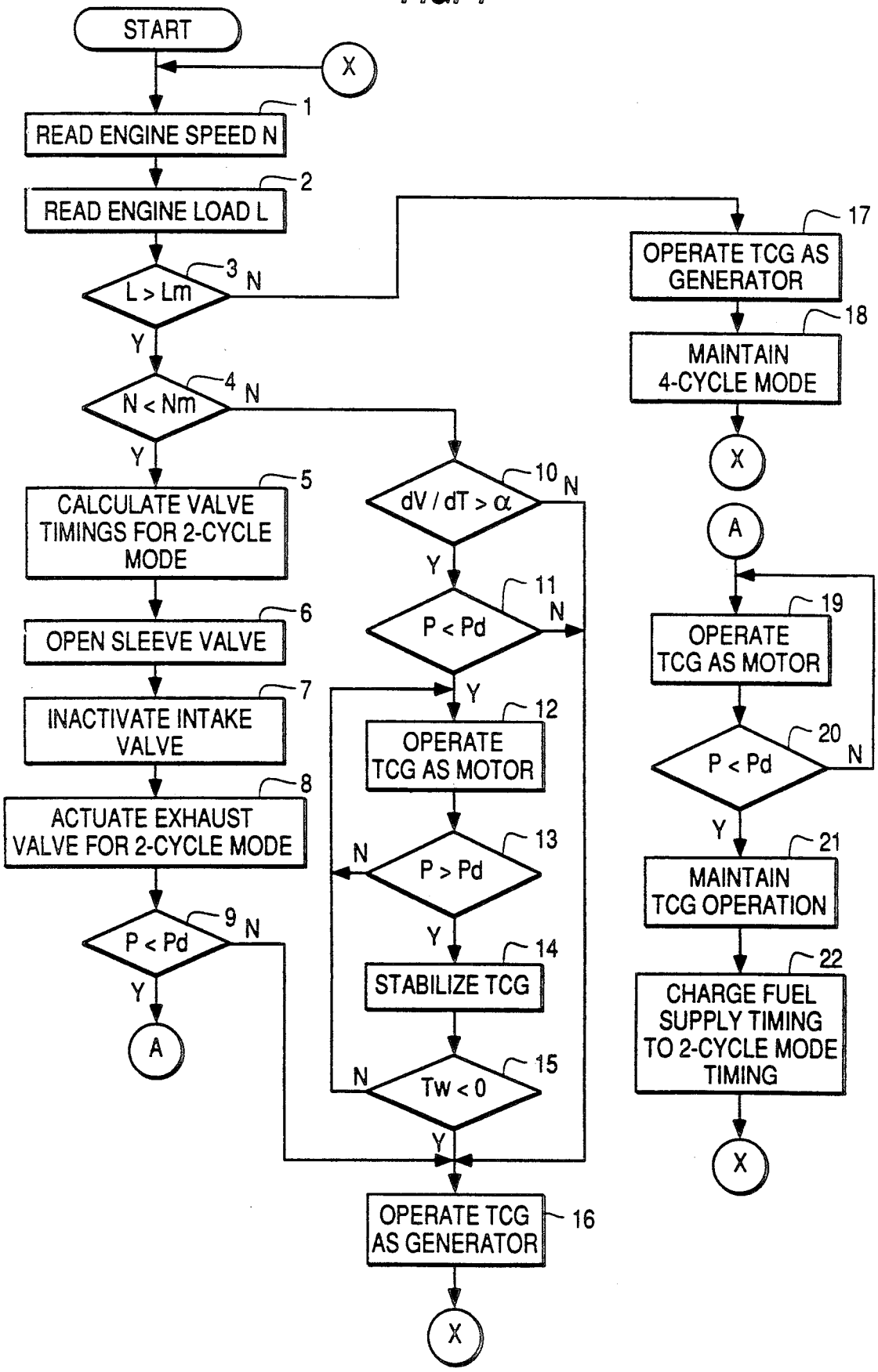
FIG. 4 is a flowchart of an operation sequence of the variable-cycle engine.

A control process of the controller 8 will now be described with reference to the flowchart of FIG. 4.

The control process starts while the engine is operating in the four-cycle mode.

The rotational speed N of the engine is read from the rotation sensor 81 in a step 1, and the load L on the engine is read from the load sensor 82 in a step 2.

The engine load L is compared with a preset load Lm in a step 3. If $L > Lm$, then control goes to a step 4. If $L \leqq Lm$, then control goes to a step 17.

In the step 17, since the engine load L is smaller than the preset load Lm, the motor-generator (TCG) of the turbocharger 7 is operated as a generator, and generated electric power is stored in the battery. The two-cycle mode of operation of the engine is maintained in a step 18, after which control goes back to the step 1.

The step 4 compares the engine rotational speed N with a preset speed Nm. If $N < Nm$, then control proceeds to a step 5, and if $N \geqq Nm$, then control goes to a step 10.

The branch sequence following the step 10 is to maintain the four-cycle mode of operation of the engine. In the step 10, the speed V of operation of the accelerator pedal is differentiated with respect to time t, thereby determining an acceleration, and if the acceleration is higher than a predetermined value c, i.e., if an acceleration mode is determined, then control goes to a step 11. If the acceleration is lower than the predetermined value $\alpha$, then control goes to a step 16.

The step 11 compares the boost pressure P detected by the pressure sensor 84 with a preset boost pressure Pd.

If $P \geqq Pd$, then since the boost pressure P is sufficient, control goes to the step 16 in which the motor-generator (TCG) is operated as a generator to recover energy, and then control returns to the step 1.

If $P < Pd$, then the motor-generator (TCG) is operated as a motor in a step 12 to increase the boost pressure up to the preset boost pressure Pd.

If the boost pressure P reaches the preset boost pressure Pd in a step 13, the operation of the motor-generator (TCG) is stabilized in a step 14. If a driving force Tw for the motor-generator (TCG) is smaller than 0 in a step 15, then control proceeds to the step 16. If not, then control goes back to the step 12.

When control goes to the step 5, the engine is operated in the two-cycle mode. In the step 5, therefore, timings to open and close the valves in the two-cycle mode are calculated.

Based on the calculated results, a control signal is applied to the fixed electromagnet 42 to bring the intake ports 12 and the holes 31 into alignment with each other, thereby positioning the sleeve valve 3 as shown in FIGS. 1 and 2.

The electromagnetic valve actuator 51 is deenergized in a next step 7, and a control signal is applied to the electromagnetic valve actuator 61 for operating the engine in the two-cycle mode in a step 8.

If the boost pressure P is lower than the preset boost pressure Pd, then a step 9 determines whether the boost pressure P has reached the preset boost pressure Pd. If the boost pressure P has not reached the preset boost pressure Pd, then control goes to a step 19. If the boost pressure P has reached the preset boost pressure Pd, then control goes to the step 16.

In the step 19, the motor-generator (TCG) is operated as a motor to increase the boost pressure P. The motor-generator (TCG) is continuously operated as the motor until the boost pressure P becomes higher than the preset boost pressure Pd in the steps 19, 20.

The operation of the motor-generator (TCG) is maintained in a step 20. The timing of supplying fuel is changed to a timing for the two-cycle mode in a step 22, after which control goes back to the step 1.

With the present invention, as described above, when the engine rotates at a low speed and under a full load, the intake ports defined in the lower portion of the cylinder are opened and the means for opening and closing an exhaust port is actuated to operate the engine in the two-cycle mode. When the engine rotates at a high speed or at a low speed and under a partial load, the intake ports are closed and the means for opening and closing intake and exhaust ports are actuated to operate the engine in the four-stroke mode. Therefore, the engine can produce a high torque when the engine rotates in a low speed range in which high torque is required. Since the sleeve valve is electromagnetically actuated and the boost pressure is always supplied to the intake pipes 13, 14, the mode of operation of the engine can quickly change between the two- and four-cycle modes.

Although a certain preferred embodiment has been shown and described, it should be understood that many changes and modifications may be made therein without departing from the scope of the appended claims.

I claim:

1. A variable-cycle engine selectively operable in different cycle modes, comprising:

a cylinder having a first intake port and an exhaust port which are defined in an upper portion thereof, and a second intake port defined in a lower portion thereof;

a cylinder sleeve fitted in said cylinder and having a third intake port defined in a lower portion thereof;

a sleeve valve circumferentially rotatably fitted over said cylinder sleeve, for selectively opening and closing said third intake port into and out of communication with said second intake port, said sleeve valve having an permanent magnet joined thereto;

rotating means for rotating said sleeve valve under electromagnetic forces acting on said permanent magnet., intake port opening and closing means for selectively opening and closing said first intake port in the upper portion of said cylinder;

exhaust port opening and closing means for selectively opening and closing said exhaust port in the upper portion of said cylinder;

supercharging means for supplying air under pres./sure to said first intake port and said second intake port; and cycle mode selecting means for actuating said rotating means to rotate said sleeve valve to open said third intake port in communication with said second intake port and operating said exhaust port opening and closing means to operate the engine in a two-cycle mode, and for actuating said rotating means to rotate said sleeve valve to close said third intake port out of communication with said second intake port and operating said intake and exhaust port opening and closing means to operate the engine in a four-cycle mode, depending on the rotational speed of the engine and the load on the engine.

2. A variable-cycle engine according to claim 1, wherein said cycle mode selecting means comprises means for operating the engine in the two-cycle mode when the engine rotates at a low speed under a full load, and for operating the engine in the four-cycle mode when the engine rotates at a high speed, and at a low speed under a partial load.

3. A variable-cycle engine according to claim 1, wherein said cylinder sleeve and said sleeve valve are made of a nonmagnetic material.

4. A control system for controlling a variable-cycle engine including a cylinder having a first intake port and an exhaust port which are defined in an upper portion thereof, and a second intake port defined in a lower portion thereof, and a supercharger for supplying air under pressure to said first and second intake ports, said control system comprising:

means for opening and closing the exhaust port and injecting fuel into the cylinder each time the engine makes one revolution when the engine rotates at a speed lower than a predetermined speed and the engine operates under a full load; and means for opening and closing the first intake port and the exhaust port and injecting fuel into the cylinder each time the engine makes two revolutions when the engine rotates at a speed higher than said predetermined speed and the engine operate under a partial load.

5. A control system according to claim 4, wherein said supercharger includes means for assisting supercharging operation thereof.

* * * * *

UNITED STATES PATENT AND TRADEMARK OFFICE

CERTIFICATE OF CORRECTION

PATENT NO. : 5,113,805

DATED : May 19, 1992

INVENTOR(S) : Hideo Kawamura

It is certified that error appears in the above-identified patent and that said Letters Patent is hereby corrected as shown below:

Title Page [57], Abstract, line 11, "an permanent" should be --a permanent--.

Col. 5, line 53, "eectro-" should be --electro---.

Col. 6, line 31, "value c," should be --value a,--.

Col. 7, line 50, "an permanent" should be --a permanent--; and line 54, "magnet., should be --magnet;--.

Col. 8, line 7, "pres./" should be --pres---.

Signed and Sealed this

Twenty-fourth Day of August, 1993

Bruce Lehman

*Attest:*

BRUCE LEHMAN

*Attesting Officer*

*Commissioner of Patents and Trademarks*